US009821206B2

(12) United States Patent
Mosher

(10) Patent No.: US 9,821,206 B2
(45) Date of Patent: Nov. 21, 2017

(54) ZIP NET PITCHER SAFETY SYSTEM

(71) Applicant: Bob Mosher, Canton, MI (US)

(72) Inventor: Bob Mosher, Canton, MI (US)

( * ) Notice: Subject to any disclaimer, the term of this patent is extended or adjusted under 35 U.S.C. 154(b) by 0 days.

(21) Appl. No.: 15/083,486

(22) Filed: Mar. 29, 2016

(65) Prior Publication Data

US 2016/0287963 A1 Oct. 6, 2016

Related U.S. Application Data

(60) Provisional application No. 62/139,953, filed on Mar. 30, 2015.

(51) Int. Cl.

| | |
|---|---|
| ***A63B 69/00*** | (2006.01) |
| ***A63B 71/02*** | (2006.01) |
| *A63B 63/00* | (2006.01) |

(52) U.S. Cl.

CPC ..... *A63B 69/0002* (2013.01); *A63B 71/022* (2013.01); *A63B 63/00* (2013.01); *A63B 2069/0006* (2013.01); *A63B 2069/0008* (2013.01); *A63B 2071/025* (2013.01); *A63B 2071/026* (2013.01); *A63B 2210/50* (2013.01); *A63B 2210/58* (2013.01)

(58) Field of Classification Search

CPC ... A63B 71/022; A63B 69/0002; A63B 63/00; A63B 2069/0006; A63B 2069/0008; A63B 2071/025; A63B 2071/026; A63B 2210/50

USPC ..... 473/451, 454–456, 422, 476–478, 434, 473/435; 273/348, 407, 410

See application file for complete search history.

(56) References Cited

U.S. PATENT DOCUMENTS

| | | | | |
|---|---|---|---|---|
| 2,827,297 A * | 3/1958 | Foster | A63B 63/00 | 273/401 |
| 3,583,703 A * | 6/1971 | Brown | A63B 63/00 | 473/456 |
| 4,456,251 A * | 6/1984 | Balaz | A63B 69/0097 | 473/435 |
| 5,527,032 A * | 6/1996 | Coleman | A63B 63/00 | 473/446 |
| 5,722,905 A | 3/1998 | Bidelman | | |
| 6,354,968 B1 * | 3/2002 | Nozato | A63B 71/022 | 473/422 |
| 6,926,060 B2 * | 8/2005 | Mark | A63B 71/022 | 473/476 |
| 7,255,658 B1 * | 8/2007 | VanKuiken | A63B 69/0002 | 473/417 |

(Continued)

*Primary Examiner* — Mitra Aryanpour

(74) *Attorney, Agent, or Firm* — The Dobrusin Law Firm, P.C.

(57) ABSTRACT

A pitcher safety system may be disclosed. The pitcher safety system may be a highly portable weather resistant collapsible pitching net. The pitcher safety system may have a curved body with an opening side, a permanently closed side, a handle side, and a carriage side. A collapsible frame comprising two pivoting base members may be permanently coupled to the interior of the curved body. The collapsible frame, a first pair of connecting members, a second pair of connecting members, and a top connecting member may be quickly coupled to one another to form a fully erected frame and safety net. The pitcher safety system may have a wheeled carriage system coupled to the carriage side, a grab handle coupled to the handle side, and hinged stabilizers coupled to the underside of the permanently closed side of the curved body.

19 Claims, 8 Drawing Sheets

(56) References Cited

U.S. PATENT DOCUMENTS

| | | | | |
|---|---|---|---|---|
| 7,413,521 | B2 * | 8/2008 | Cherry | A63B 71/022 473/451 |
| 7,770,913 | B2 * | 8/2010 | Cannon | B62B 1/08 280/278 |
| 9,604,112 | B2 * | 3/2017 | Gilman | A63B 69/00 473/454 |
| 2016/0287963 | A1 * | 10/2016 | Mosher | A63B 69/0002 473/454 |

* cited by examiner

ZIP NET PITCHER SAFETY SYSTEM

CROSS-REFERENCE TO RELATED APPLICATIONS

This application claims priority to U.S. Provisional Patent Application No. 62/139,953 filed Mar. 30, 2015, and entitled ZIP NET APPARATUS AND SYSTEM, the entire contents of which are hereby incorporated by reference.

BACKGROUND

Baseball, Softball, and other competitive pitching sports inadvertently place the pitcher in close proximity to the batter. The pitcher is often finishing the pitching movement during and or after the batter makes contact with the ball. Consequently, the return of the ball occurs during a relatively short time period while the pitcher is off guard and cannot easily field the returned ball. The combination of the pitchers proximity to the batter, the short time period between the pitch and the return of the ball, and the subsequent winding down motion of the pitcher inadvertently causes the pitcher to be vulnerable.

More particularly, pitchers are vulnerable during batting practice because of increased exposure. During batting practice, pitchers tend to throw soft pitches to the batter so that the batter can make the most effective contact and thereby improve his batting performance. It is not uncommon for a pitcher to throw several hundred pitches and receive several hundred batted balls in return during a single session of batting practice. Additionally, many teams and players practice in multiple locations thereby increasing the need for a hyper mobile lightweight apparatus that can withstand the test of time.

Many existing pitching nets are bulky, expensive, complicated, and are susceptible to becoming easily weathered. These problems inevitably result in many pitchers foregoing protection because the usage of existing products is inconvenient. The present invention aims to solve the previously mentioned problems.

SUMMARY

According to an exemplary embodiment, a pitcher safety system may be disclosed. The curved body may have an opening side, a permanently closed side, a handle side, and a carriage side. The pitcher safety system may have an undercarriage unit disposed on a distal end of the curved body. At least one wheel may be disposed on the undercarriage frame. The curved body may have a pair of opposing hinged stabilizers that may swing open for stabilization of the pitcher safety system or may swing back to a closed position to facilitate easy transportation. A grab handle may be disposed on the handle side. Two panels may be disposed on the outer perimeter edge of the opening side of the curved body. The hinged panels may allow a user to access the interior of the curved body from an open position while maintaining the contents inside when in a closed position. The curved body may have an interior void space that may house a collapsible frame, connecting members, and slip net for further erection. The hinged panels may be partially or optionally completely circumscribed by at least one buckle and strap fastener. The buckle and strap fastener may be coupled to the curved body at any feasible location such that the hinged doors and opening side of the curved body may be partially or optionally completely circumscribed. The buckle and strap fastener may optionally be coupled to each opposing panel by a snap fastener. A collapsible frame and connecting members may be housed within the interior of the curved body. The collapsible frame may have two pivoting base members that are coupled to the interior of the curved body. The two pivoting base members may pivot away from the permanently closed side of the curved body. Furthermore, they may be coupled to the frame by a hinged element, a pinned element, or any alternate element as would be understood by a person having ordinary skill in the art. The interior of the curved body may also house other framed elements that are not permanently coupled to the curved body. These may include but are not limited to; a first pair of connecting members with protruding ends, a second pair of connecting members with receiving ends, and a top connecting member with protruding ends may also be housed within the curved body. The first pair of connecting members with protruding ends may couple to the receiving end of the pivoting base members. The second pair of connecting members may couple to the first pair of connecting members by sliding the receiving ends of the second pair of connecting members over the protruding ends of the first pair of connecting members. The top member may complete the framing system by coupling to the receiving end of the second pair of connecting members via insertion of the protruding ends of the top member into the receiving ends of the second pair of connecting members. By coupling the top member to the second pair of connecting members a slip net may slide up the collapsible frame and connecting members thereby creating a complete pitcher safety system. The slip net may be an ultraviolet weather resistant net with a reinforced edge along the perimeter. The reinforced edge may be coupled to a series of rings such that the rings may easily slide up and down the frame members by pulling the top connecting member and slip net upwards and downwards as desired. The rings may also provide reinforcement for a force to be transferred from the slip net to the frame and through the stabilizers.

An exemplary method of erection and use for a pitcher safety system may be disclosed. First, a user may extend the hinged stabilizers by pulling them outward. Second, a user may unbuckle the buckle and strap fastener disposed to the panels. Third, the user may pivot the two base members to the fully erect position, which may result in the base members standing erected and perpendicular to the curved body of the pitcher safety system. Fourth, the user may insert the pair of first connecting members into the receiving ends of the pivoting base members. Fifth, the user may attach the pair of second connecting members by slipping the second connecting members over the protruding ends of the first connecting members. Sixth, the user may slide a top connecting member upwards and couple the top connecting member to the second connecting members by inserting the protruding ends into the receiving ends of the second connecting members. By sliding, the top connecting member upward and coupling it to the second connecting members the user has created a completed and fully erect pitcher safety system.

BRIEF DESCRIPTION OF THE FIGURES

Advantages of embodiments of the present invention will be apparent from the following detailed description of the exemplary embodiments. The following detailed description should be considered in conjunction with the accompanying figures in which:

Exemplary FIG. 1 may show a pitcher safety system compacted for transportation;

Figure 1:
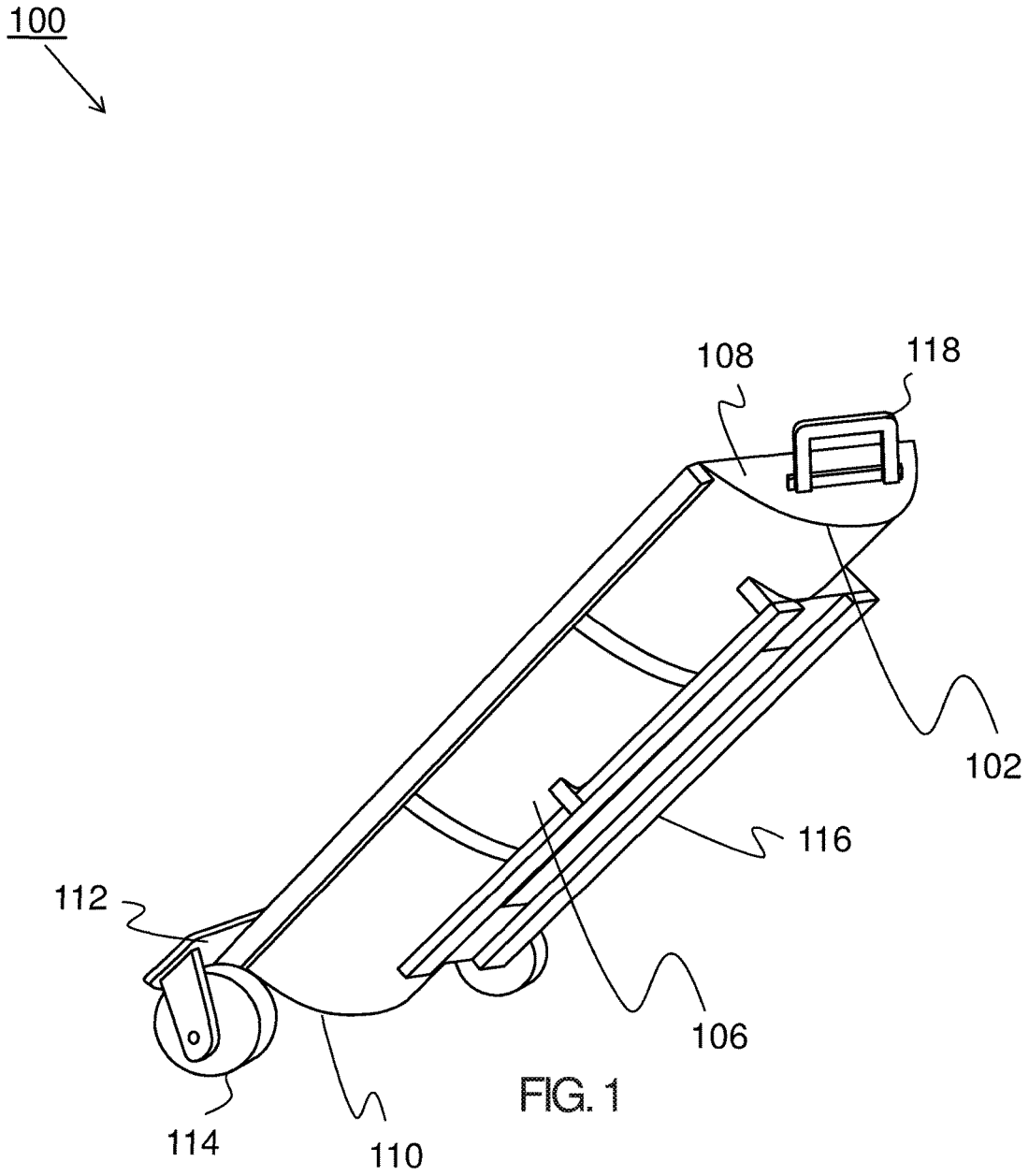
Figure 2:
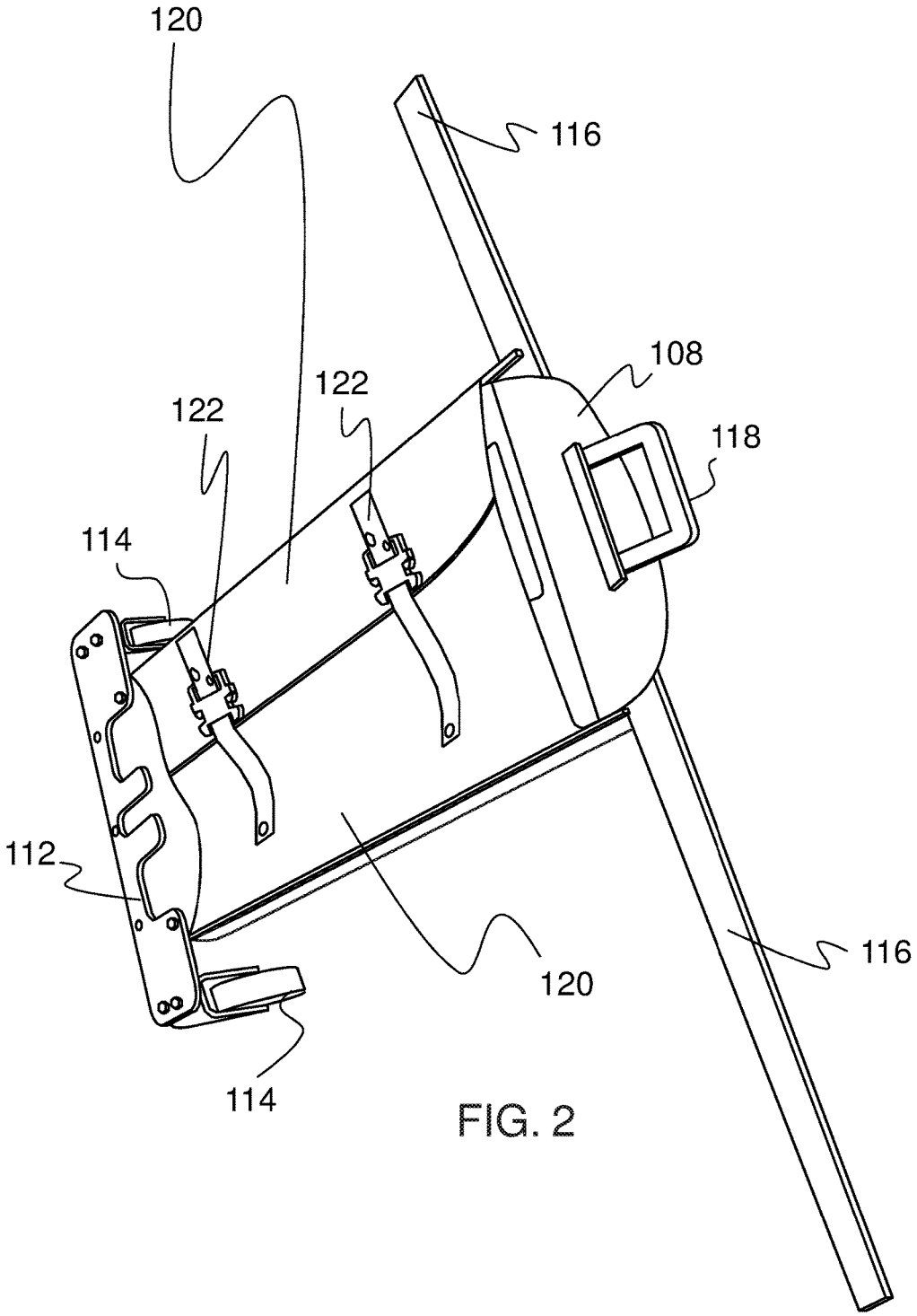
Figure 3:
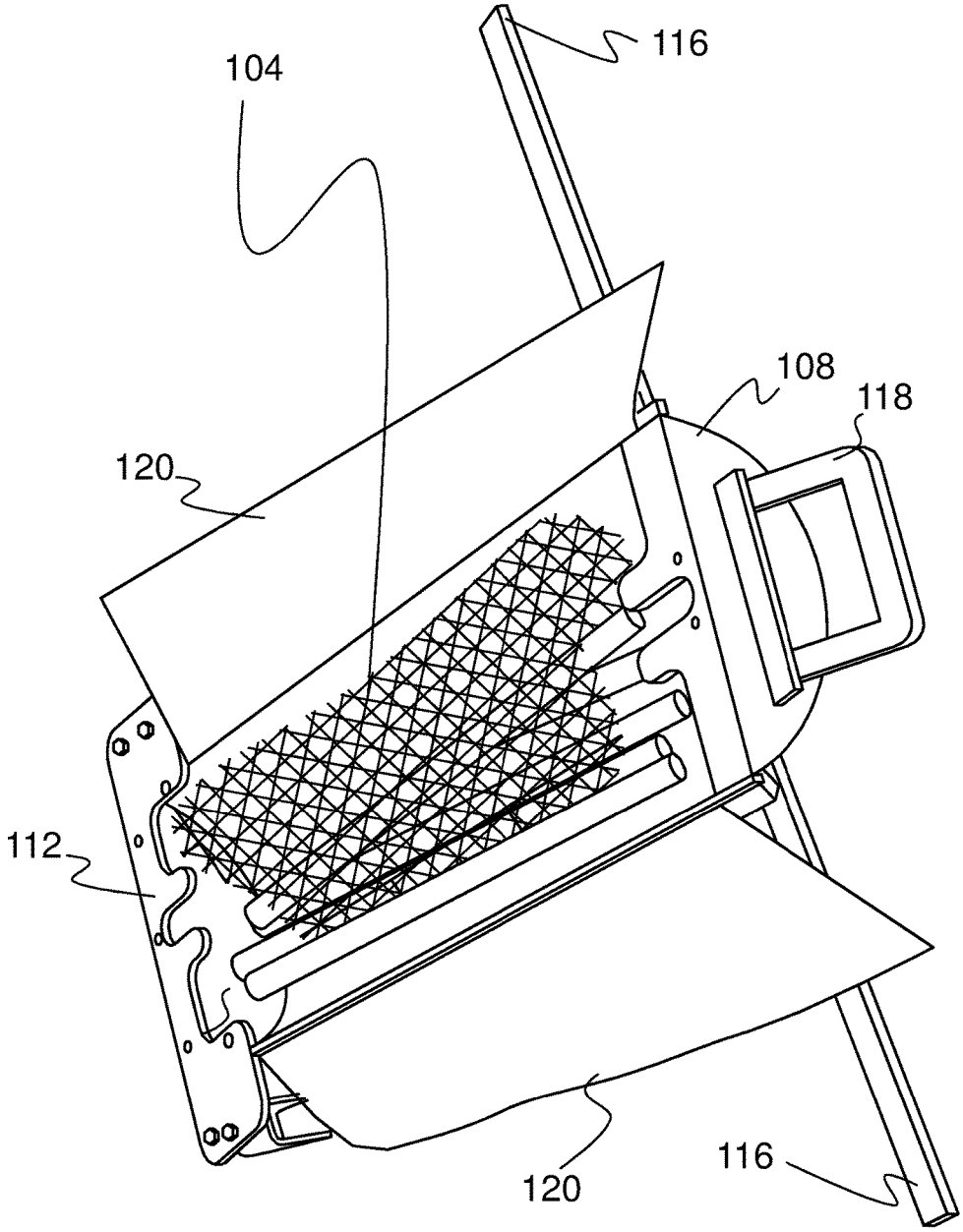
Figure 4:
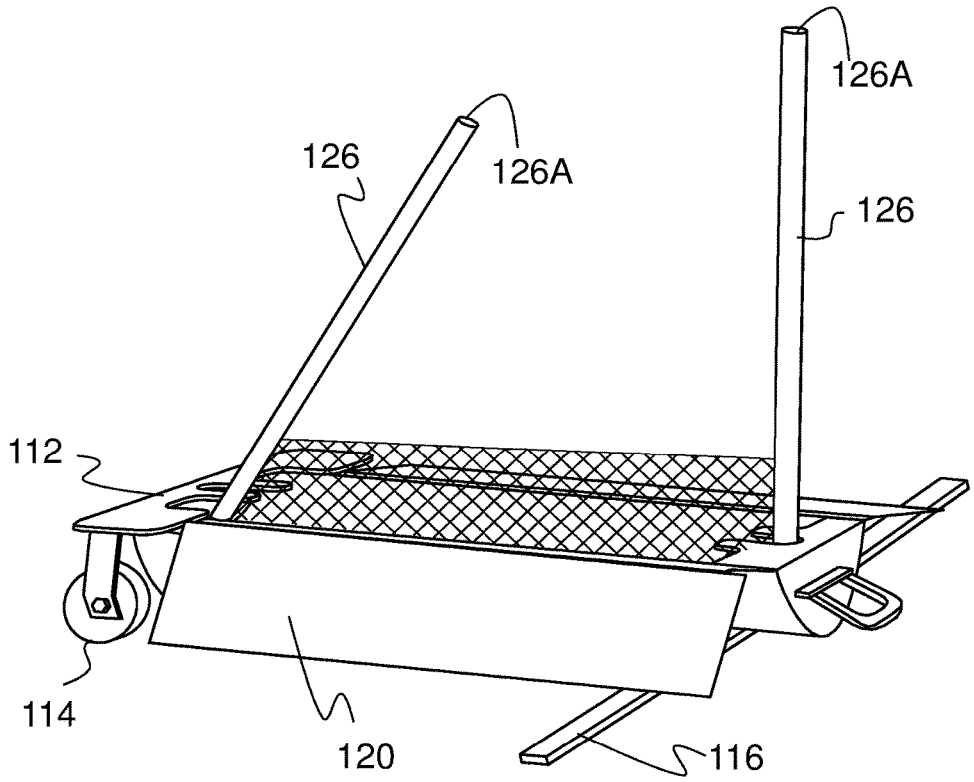
Figure 5:
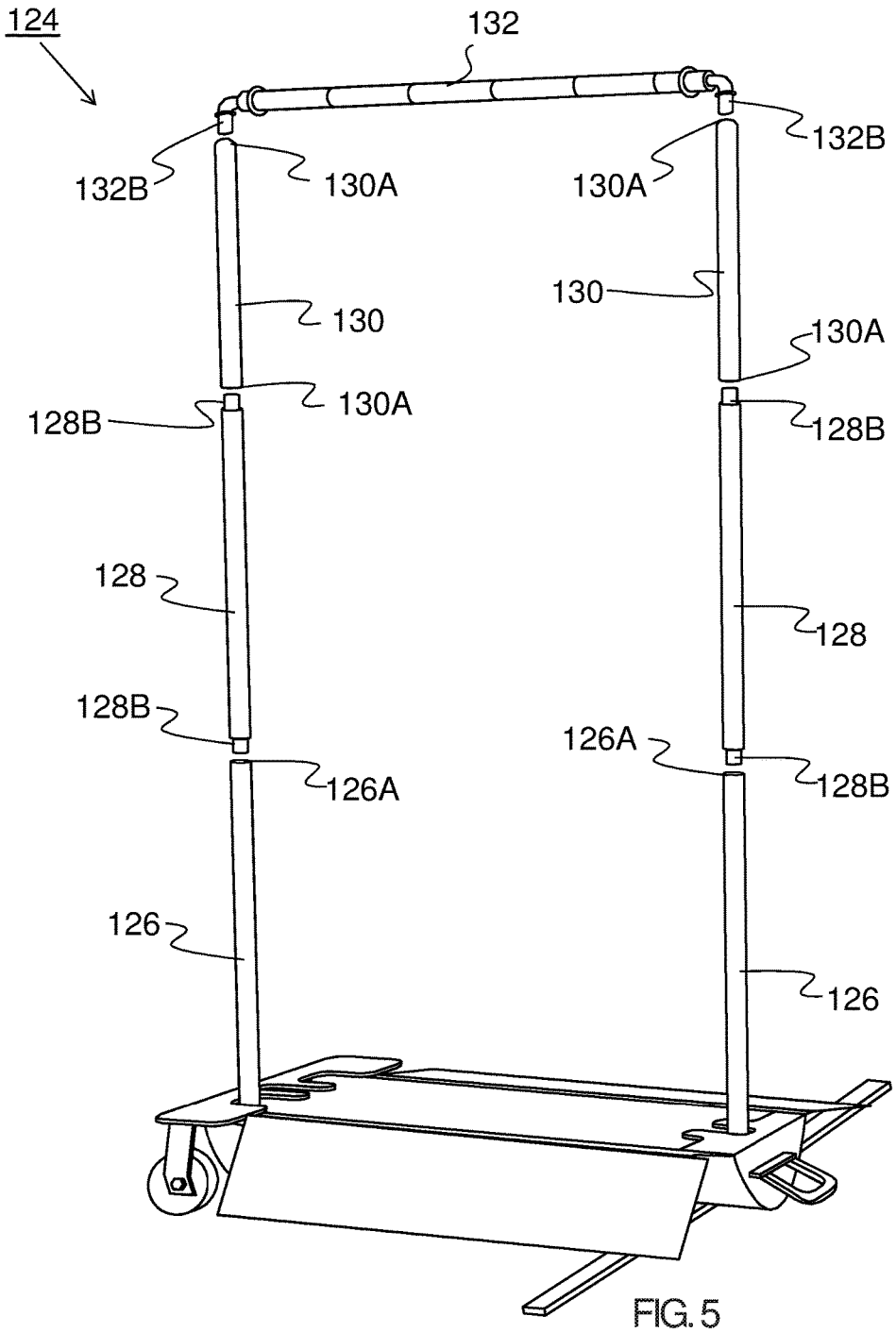
Figure 5A:
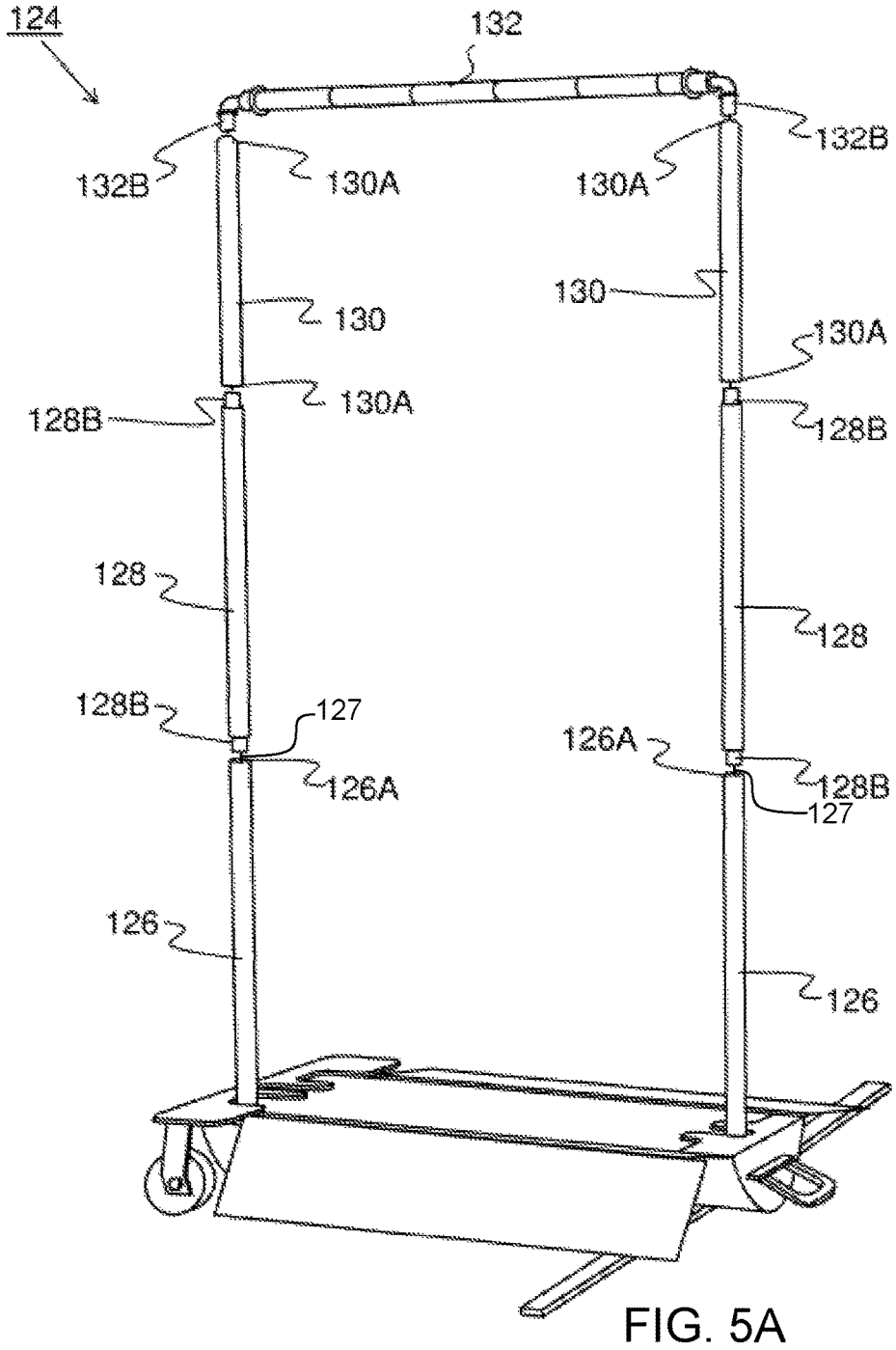
Figure 6:
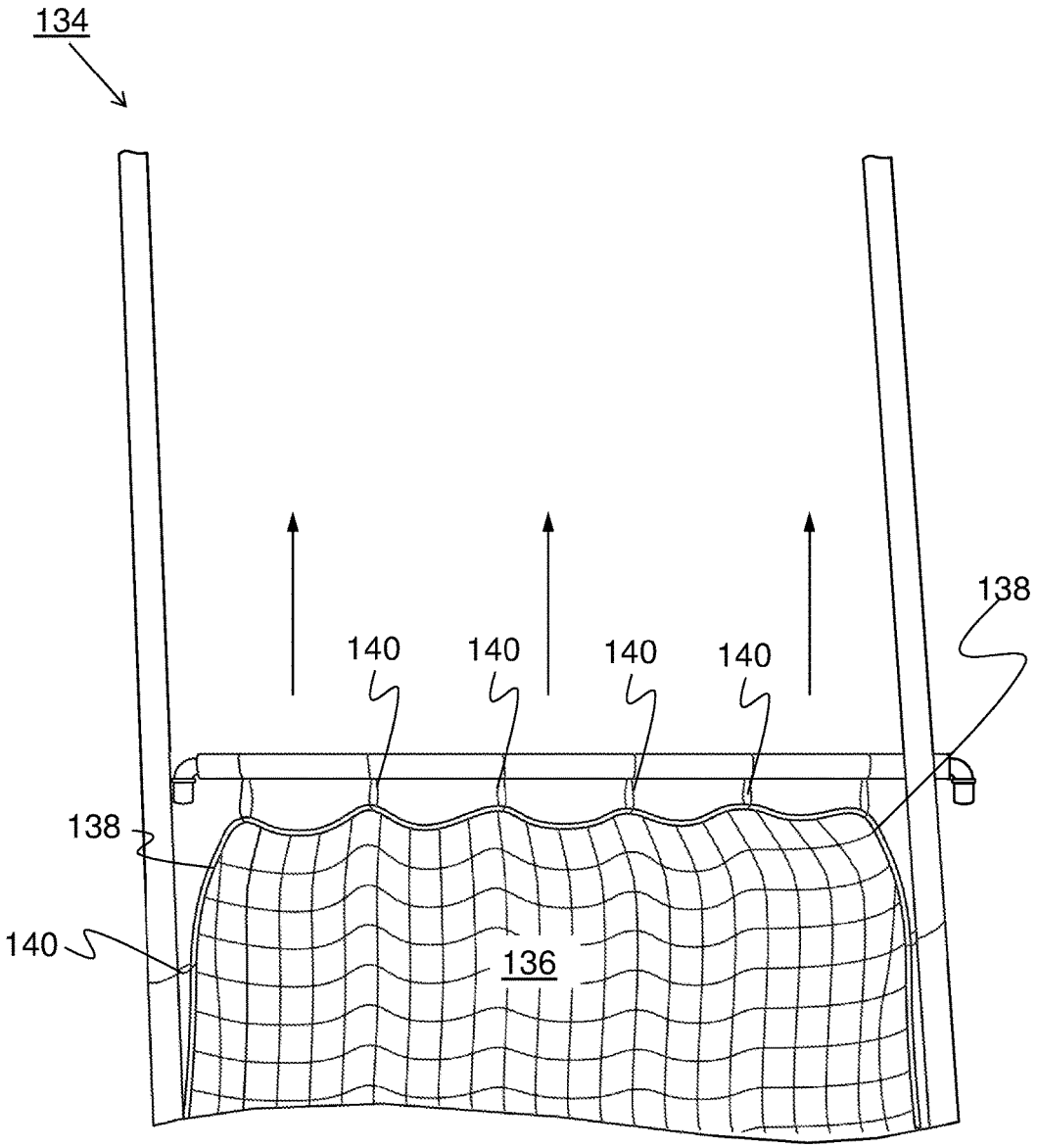
Figure 7:
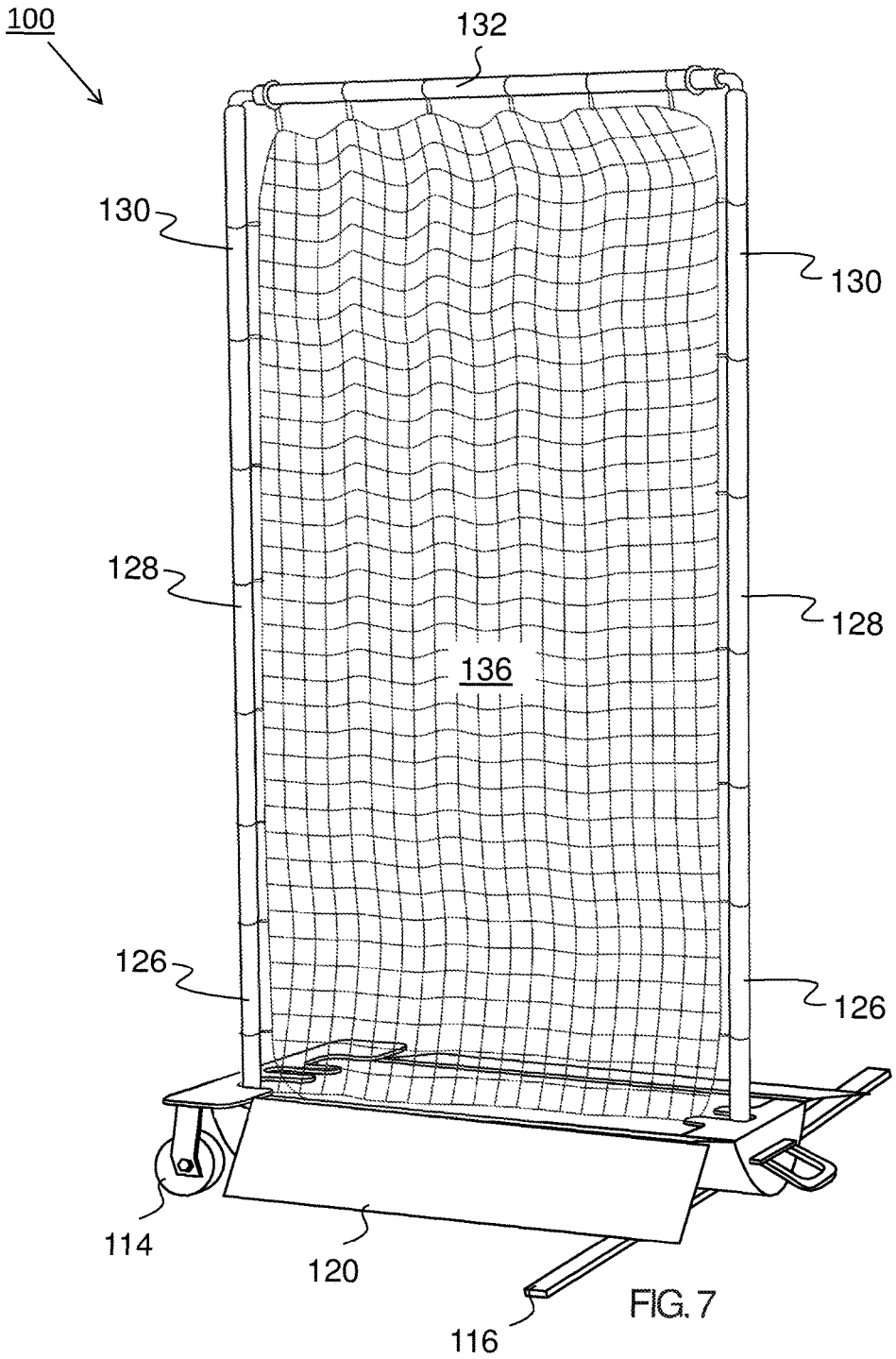

Exemplary FIG. 2 may show a pitcher safety system with the stabilizing arms deployed;

Exemplary FIG. 3 may show a pitcher safety system with panels in an open position;

Exemplary FIG. 4 may show an initial phase of erection of a pitcher safety system;

Exemplary FIG. 5 may show the connecting members disjoined in space for illustrative purposes;

Exemplary FIG. 5A may show the connecting members joined by a string, filament, or wire in a required order of erection for illustrative purposes;

Exemplary FIG. 6 may show a top connecting member sliding up along the other connecting members of a pitcher safety system;

Exemplary FIG. 7 may show a fully erect and assembled pitcher safety system.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a pitcher safety system may be generally disclosed. The pitcher safety system may be a highly portable collapsible pitching net. The pitcher safety system may have a curved body with an opening side, a permanently closed side, a handle side, and a carriage side. The curved body may be composed of a lightweight aluminum alloy or it may be composed of a durable ultraviolet and weather resistant plastic or plastic composite. Optionally, it may be a combination of metallic and plastic components. The pitcher safety system may have a series of lightweight members that can be quickly assembled and disassembled. The collapsible frame may have two pivoting base members that may optionally be permanently coupled to the interior of the curved body. The pivoting base members may quickly fold outwards and inwards by a hinged element or a pinned element as would be understood by a person having ordinary skill in the art. The collapsible frame, a first pair of connecting members, a second pair of connecting members, and a top connecting member may be quickly coupled to one another to form a fully erected frame. The members may optionally have a string, filament, or wire that is operably connecting them in the required order of erection as would be understood by a person having ordinary skill in the art and as illustrated in FIG. 5A, the string filament or wire represented by reference numeral 127. For example, the string, filament, or wire may travel through the interior of the connecting members so that a user may very quickly line the protruding and receiving ends of the connecting members up for further coupling and erection. Additionally, the members may retain the unique order of erection when disassembled and stored within the interior of the pitcher safety system. A top connecting member may have an ultraviolet and weather resistant net coupled to it such that when the top connecting member is coupled to the other connecting members the net may "slip" up the connecting members thus effortlessly providing a protection net. The pitcher safety system may have an undercarriage system and wheels coupled to the carriage side and a grab handle coupled to the handle side. The wheels and grab handle may allow a user to easily and effectively transport the pitcher protection system as if it were a luggage article.

Referring to the figures generally, a pitcher safety system 100 may be disclosed. The pitcher safety system 100 may have a curved body 102 with an opening side 104, a permanently closed side 106, a handle side 108, and a carriage side 110. An undercarriage frame 112 may be attached to the carriage side 110 of the curved body 102. The undercarriage frame 112 may be bolted, welded, or optionally a seamless addition to the curved body 102 itself. The undercarriage frame 112 may have at least one wheel 114 disposed to it to facilitate transportation of the pitcher safety system 100. The undercarriage frame 112 may have two wheels 114 attached to opposite ends of the undercarriage frame 112. The wheels 114 may be rubber inflatable wheels or they may be hard durable plastic or plastic composite wheels 114. The wheels 114 may rotate 360 degrees in any direction such that they are capable of freely spinning. The wheels 114 may have a locking element as would be understood by a person having ordinary skill in the art.

Referring to the figures generally, a pitcher safety system 100 may be disclosed. The pitcher safety system 100 may have a pair of hinged stabilizers 116 coupled to the permanently closed side 106 of the curved body 102. The hinged stabilizers 116 may be coupled by a hinge, pin and lock, or other attaching means as would be understood by a person having ordinary skill in the art. The hinged stabilizers 116 may swing away from the permanently closed side 106 thereby creating a stabilizing arm for the pitcher safety system. The hinged stabilizers may swing out approximately 90 degrees from the permanently closed side 106. Alternatively, the hinged stabilizers 116 may swing out from the permanently closed side 106 from a range of approximately 60 degrees to approximately 120 degrees as measured from the edge of the permanently closed side 106. The hinged stabilizers 116, the wheel 114, and the undercarriage frame 112 may provide structural support to a fully erected pitcher safety system 100. The hinged stabilizers 116 and the wheel 114 and undercarriage frame 112 may come into contact with the ground and be generally considered the base of the pitcher safety system 100. The pitcher safety system 100 may have a grab handle 118 disposed on the handle side 108 of the curved body 102. The grab handle 118 may be a rigid handle or optionally it may be partially collapsible. For example, the grab handle 118 may have a pin and or hinged elements as would be understood by a person having ordinary skill in the art. The grab handle 118 may further provide a stabilizing force and assist the hinged stabilizers 116, the wheels 114, and the undercarriage frame 112 in providing structural support. Optionally, the grab handle 118 may not come into contact with the ground such that it does not provide any structural support. Another advantageous feature of the grab handle is for the facilitation of transportation.

Referring to the figures generally, a pitcher safety system 100 may be disclosed. The pitcher safety system 100 may have two panels 120 that may be of equal size. Alternatively, one of the panels 120 may be larger than the other panel as may be required or advantageous for various interior components and or members. For example, one panel may be larger than the other panel such that it may partially cover the other panel such that there is no opening in the middle of the two panels 120. The panels 120 may be rigid or they may be flexible. The panels 120 may be a lightweight flexible material that may be easily customized with an ornamental appearance. For example, the panels may be easily painted with a team logo, a manufacturer logo, an individual's name, or instructions for operating the pitcher safety system 100. The panels 120 may be adhered to the perimeter of the opening side 104 of the curved body 102 by a glue or epoxy. Alternatively, the panels may be fastened along the perimeter of the opening side 104 of the curved body 102 by snap fasteners as would be understood by a person having ordinary skill in the art. The panels may be permanently attached to the pitcher safety system or they may be optionally removable. For example, the panels may be coupled by a hinged element or a pinned hinged element. It may be advantageous for the panels to be removable to facilitate cleaning and further ornamental differentiation of the panels 120. The panels 120 may remain closed by the use of at least one buckle and strap fastener 122. The buckle and strap fastener 122 may have a first end which may be attached to a first panel by a snap fastener and a second end which may be attached to a second panel by a snap fastener 122 as would be understood by a person having ordinary skill in the art. The buckle and strap fastener may be buckled and tightened such that the panels may remain in a closed position or they may be un-buckled so they may be opened. The buckle and strap fastener 122 may be disposed on the curved body such that it partially or completely circumscribes the curved body 102 and the panels 120.

Referring to the figures generally, a pitcher safety system 100 may be disclosed. The pitcher safety system 100 may have an interior space that may be accessed by opening the panels 120 and the buckle and strap fastener 122. The interior space may be used to store a collapsible frame 124, a first pair of connecting members 128, a second pair of connecting members 130, a top connecting member 132, and a slip net 134. A collapsible frame 124 may consist of two pivoting base members 126 permanently coupled to the interior of the curved body 102. The two pivoting base members 126 may pivot open to create a base for the other members to attach to. The two pivoting base members 126 may have an open end opposite from the hinged pivoting end. The open end may be a receiving end 126A sized to receive a protruding end 128B of a pair of first connecting members 128. The open end of the pivoting base member may be circular and simply be an open void space. A first connecting member 128 may have protruding ends 128B on both sides. A pair of first connecting members 128 may couple to the pivoting base members 126 by inserting the protruding ends 128B into the receiving ends 126A as would be understood by a person having ordinary skill in the art. A second connecting member 130 may have open receiving ends 130A. The second connecting member 130 may couple to the first connecting member 128 by sliding the receiving end 130A of the second connecting member over the protruding end 128B of the first connecting member 128 as would be understood by a person having ordinary skill in the art. A top connecting member 132 may have two protruding ends 132B at right angles relative to the major axis of the top connecting member 132. A top connecting member 132 may couple to the second connecting members 130 by inserting the protruding ends 132B of the top connecting member 132 into the receiving ends 130A of the second connecting member 130 as would be understood by a person having ordinary skill in the art. The receiving ends and protruding ends may be of any size such that they may fit firmly together and automatically snap or lock firmly into place. Optionally, the receiving ends and protruding ends may have a groove and rail such that they may have further structural attaching support. The receiving ends and protruding ends may also feature a twisting lock detailing as would be understood by a person having ordinary skill in the art.

Referring to the figures generally, a pitcher safety system 100 may be disclosed. The pitcher safety system 100 may have a top connecting member 132. The top connecting member 132 may have a series of rings that circumscribe the minor axis of the top connecting member 132 such that they may slide across portions of the major axis of the top connecting member. The rings 140 may be composed of metal, plastic, organics, composite materials, etc. or any other low friction highly durable material as would be understood by a person having ordinary skill in the art. The rings 140 may be coupled to a reinforced perimeter 138 of a net 136. The net 136 may be permanently coupled to the rings 140 or the net may be removable from the rings as would be understood by a person having ordinary skill in the art. The pitcher safety system 100 may have a net 136 that may "slip" or slide up a collapsible frame 124, pivoting base members 126, a pair of first connecting members 128, a pair of second connecting members 130, by raising a top connecting member 132. The net 136 may be fully erected and secured in a final erect position by coupling the top connecting member 132 to the second connecting members 130. The rings 140 may slide freely and effortlessly along the various members of the pitcher safety system 100. It should be apparent that the pitcher safety system may be quickly erected with significant ease on the part of the user merely by coupling or snapping the various connecting members into place because the net is automatically erected when the top connecting member 132 is coupled in place.

Referring to the figures generally, an exemplary method of how to erect a pitcher safety system 100 may be disclosed. First, a user may extend the hinged stabilizers. Second, a user may unbuckle the buckle and strap fastener 122 disposed to the panels 120 and flip the panels open. Third, the user may pivot the two base members 126 to the fully erect position, which may be result in the base members standing erect perpendicular to the curved body 102. Fourth, the user may insert the pair of first connecting members 128 into the receiving ends 126A of the pivoting base members. Fifth, the user may attach the pair of second connecting members 130 by slipping the second connecting members 130 over the protruding ends 128B of the first connecting members 128. Sixth, the user may slide a top connecting member 132 upwards and couple the top connecting member 132 to the second connecting members 130 by inserting the protruding ends 132B into the receiving ends 130A of the second connecting members 130. By sliding, the top connecting member 132 upward and coupling it to the second connecting members 130 the user has created a completed and erect pitcher safety system because the net 136, by way of its unique attachment and configuration to the top connecting member 132, may quickly slide up along the various connecting members. The net may receive structural rigidity due to the attachment of the rings 140 to the reinforced perimeter 138 of the net.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A portable pitcher safety system comprising:

a lightweight curved body with an opening side and an opposing permanently closed side, a handle side, and a carriage side; wherein the handle side and carriage side are arranged generally transverse to the opening side and permanently closed side; wherein the handle side and carriage side are located on opposing sides of the curved body; wherein during transport of the pitcher safety system, the handle side is oriented generally upward and the carriage side is oriented generally downward toward the ground; and wherein the sides of the body define an interior void space;

an undercarriage frame attached to the carriage side of the curved body that extends from one portion of the opening side to an opposing portion of the opening side of the curved body, the undercarriage frame having one or more undulations;

at least one wheel disposed on the undercarriage frame;

an opposing frame portion extending generally transverse to the handle side and extending from one portion of the opening side to an opposing portion of the opening side of the curved body, the opposing frame portion having one or more undulations;

a pair of hinged stabilizers attached to the permanently closed side of the curved body, wherein the hinged stabilizers are adapted to swing out from the curved body to provide stabilization to the pitcher safety system;

a grab handle disposed on the handle side of the curved body;

two panels coupled to the outer perimeter edge of the opening side of the curved body;

at least one fastener disposed on the panels, wherein the panels are adapted to be moved to provide access to the interior void space;

a collapsible frame comprising two pivoting base members permanently coupled to an interior surface of the curved body; wherein the pivoting base members are received within and supported by the one or more undulations of the undercarriage frame and the one or more undulations of the opposing frame portion; and wherein the pivoting base members have receiving ends;

a pair of first connecting members with protruding ends, which are adapted to be received within the receiving ends of the pivoting base members, and opposing protruding ends;

a pair of second connecting members with receiving ends, which are adapted to receive the opposing protruding ends of the first connecting members, and opposing receiving ends;

a top connecting member with protruding ends at right angles relative to the top connecting member; wherein the protruding ends of the top connecting member are adapted to be received within the opposing receiving ends of the second connecting members; and a net attached to the top connecting member;

wherein the net further comprises a reinforced perimeter and a plurality of rings coupled to the reinforced perimeter for securing the net to the top connecting member, pair of first connecting members, and pair of second connecting members.

2. The pitcher safety system of claim 1, wherein the net is formed of an ultraviolet resistant material.

3. The pitcher safety system of claim 1, wherein the rings are formed of metal.

4. The pitcher safety system of claim 1, wherein the rings are formed of plastic.

5. The pitcher safety system of claim 1, wherein the at least one fastener is a buckle and strap fastener that is disposed on both panels by snap fasteners.

6. The pitcher safety system of claim 1, wherein the at least one fastener is a buckle and strap that is disposed on the outer side wall of the curved body.

7. The pitcher safety system of claim 1, wherein the panels are formed of a pliable lightweight material.

8. The pitcher safety system of claim 1, wherein the panels are coupled to the curved body by hinges.

9. The pitcher safety system of claim 1, wherein the panels are coupled to the curved body by snap fasteners.

10. The pitcher safety system of claim 1, wherein the panels are coupled to the curved body by an adhesive.

11. The pitcher safety system of claim 1, wherein the panels are marked with identification ornamentation.

12. The pitcher safety system of claim 1, wherein the receiving ends and protruding ends are twist locking couplers.

13. The pitcher safety system of claim 1, wherein the receiving ends and protruding ends are groove and rail couplers.

14. The pitcher safety system of claim 1, wherein the net is adapted to slide up the pivoting base members, the pair of first connecting members, and the pair of second connecting members upon raising the top connecting member.

15. The pitcher system of claim 14, wherein one of the first connecting members is operatively connected to one of the second connecting members by a string, filament, or wire in a required order of erection.

16. The pitcher system of claim 1, wherein the pivoting base members, the first connecting members, second connecting members, the top connecting member, and the net are adapted to be stored within the interior void space of the body when the pitcher system is not in erected orientation.

17. The pitcher system of claim 1, wherein the at least one wheel has a locking element for preventing the at least one wheel from rotating while the pitcher system is in use.

18. The pitcher system of claim 1, wherein the grab handle provides a stabilizing force to assist the hinged stabilizers and the wheels in providing structural support.

19. The pitcher system of claim 1, wherein the hinged stabilizers swing out from the permanently closed side of the curved body at an angle of about 60 degrees to about 120 degrees and measured from an edge of the permanently closed side;

wherein the panels are hingedly coupled to the curved body;

wherein the at least one fastener is a buckle and strap fastener that is disposed on both panels;

wherein the net is adapted to slide up the pivoting base members, the pair of first connecting members, and the pair of second connecting members upon raising the top connecting member; and wherein the pivoting base members, the first connecting members, second connecting members, the top connecting member, and the net are adapted to be stored within the interior void space of the body when the pitcher system is not in erected orientation.

* * * * *